United States Patent [19]

Phillips

[11] 4,133,285

[45] Jan. 9, 1979

[54] BOAT PADDLE

[76] Inventor: Wayne R. Phillips, 2260 Germantown Sq. West, Germantown, Tenn. 38138

[21] Appl. No.: 816,890

[22] Filed: Jul. 18, 1977

[51] Int. Cl.[2] ..... B63H 16/04

[52] U.S. Cl. ..... 115/24.1; 416/74

[58] Field of Search ..... 115/24.1, 24.2, 24.3; 416/74; 135/65, 66; 294/57, 58; 16/110 R

[56] References Cited

U.S. PATENT DOCUMENTS

| | | | |
|---|---|---|---|
| 1,324,554 | 12/1919 | Kozlowski | 135/66 X |
| 2,140,884 | 12/1938 | Shape | 115/24.1 |
| 2,642,074 | 6/1953 | Pedley et al. | 135/65 |
| 2,998,613 | 9/1961 | Lynn et al. | 115/24.1 X |

*Primary Examiner*—Trygve M. Blix
*Assistant Examiner*—Sherman D. Basinger
*Attorney, Agent, or Firm*—Walter Potoroka, Sr.

[57] ABSTRACT

A paddle for a boat such as a canoe having a blade and a handle connected by an intermediate portion, all on a common axis, is formed with a modified T-shaped or contoured handle comprising a cross member at the end of the intermediate portion, the cross member being normal to the axis and having discreet prominent projections at the ends thereof extending toward the blade generally parallel to the axis and the intermediate portion being gently enlarged near the handle to provide an abutment or support for the canoeist's palm when his fingers grasp the handle in use of the paddle, the projection, cross member and abutment on each side of the axis of the paddle being formed to provide a generally circular opening of sufficient size to receive the base of the canoeist's thumb and with an access slot having a width approximately the diameter of the circular opening between the free end of the projection and the abutment, the free ends of the projections extending at least to approximately the line joining the centers of the circular openings, the centerline of each slot forming an acute angle with the axis of the paddle, whereby either of the circular openings provide a thumb saddle to improve the grip during canoeing and the projections provide an effective hook when the paddle is held by the intermediate portion and pulled.

6 Claims, 6 Drawing Figures

BOAT PADDLE

BRIEF SUMMARY OF THE INVENTION

My U.S. Pat. No. 3,970,032 teaches a paddle wherein the planes of the blade and handle are misaligned, for the purpose stated, one feature of the paddle being grapple means formed in the handle.

It has been found that the specific grapple structure disclosed in the above patent may be modified to provide improved dual functions of an improved grapple and a thumb "saddle" during canoeing.

Accordingly, a main object of the invention is to provide a paddle having a handle formed to provide a slot to receive the canoeist's thumb when the fingers grasp the end of the handle.

Another main object of the invention is to provide a paddle wherein the thumb slot comprises a hook effective for uses such as snagging or seizing items such as a tree branch, articles of clothing, a minnow bucket handle, etc., when the paddle is held near the blade end thereof, for example.

A still further object of the invention is to provide a paddle having a modified T-shaped handle with discreet projections at the ends of the handle cross member extending toward the blade portion of the paddle to form an effective hook, the hook serving also as a thumb saddle during use of the paddle.

More specifically, an object of the invention is to provide a paddle substantially as described in the Abstract.

BRIEF DESCRIPTION OF THE VARIOUS VIEWS OF THE DRAWINGS

DETAILED DESCRIPTION

Figure 2:
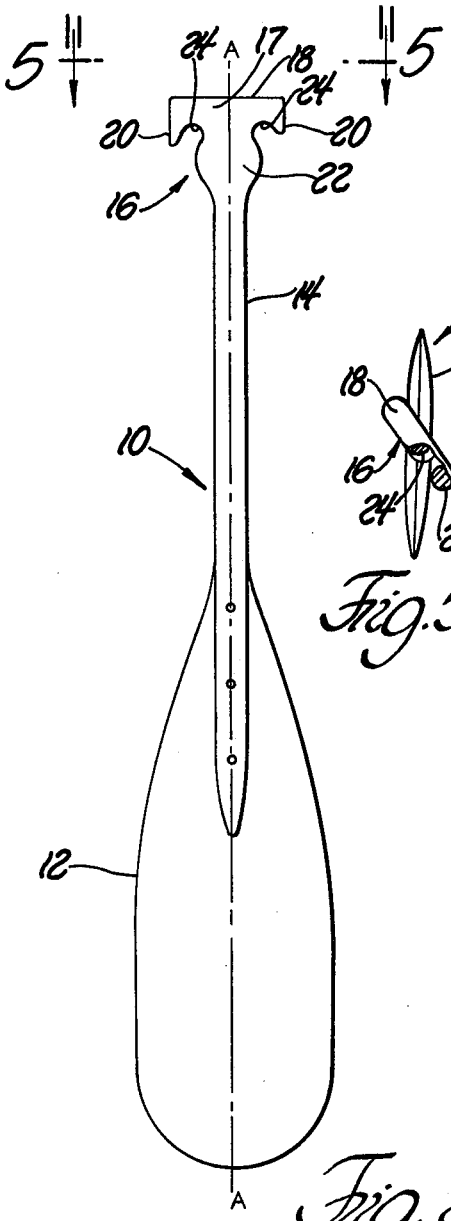
FIG. 2 is a side elevational view of a paddle having a handle embodying the invention.

Referring now to the drawings in greater detail, FIG. 2 illustrates a paddle 10 having a blade portion 12, an intermediate portion 14 and a handle portion 16, all having a common axis A—A.

Figure 1:
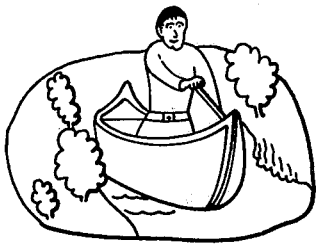
FIG. 1 is a perspective view of a canoeist using a paddle that may embody the invention.

FIG. 1 illustrates, for purposes of reference in explanation of the paddle structure, a canoeist using a paddle of the general type disclosed herein. It will be noted, in FIG. 1, that the canoeist has gripped the handle portion 16 with his right hand, with the right arm being crossed toward the left side of the body, and the intermediate portion 14 with his left hand. In paddling, the handle 16 held by the right hand serves as a moving (working) fulcrum about which the paddle blade 12 is stroked rearwardly (for forward motion of the canoe) by the left hand. Of course, the right hand and arm may also have a stroking function, as well as the fulcrum function.

It is apparent from the above brief description of use of paddle 10 for paddling purposes that the handle 16 should be formed to facilitate the working moving fulcrum and stroking functions.

Figure 3:
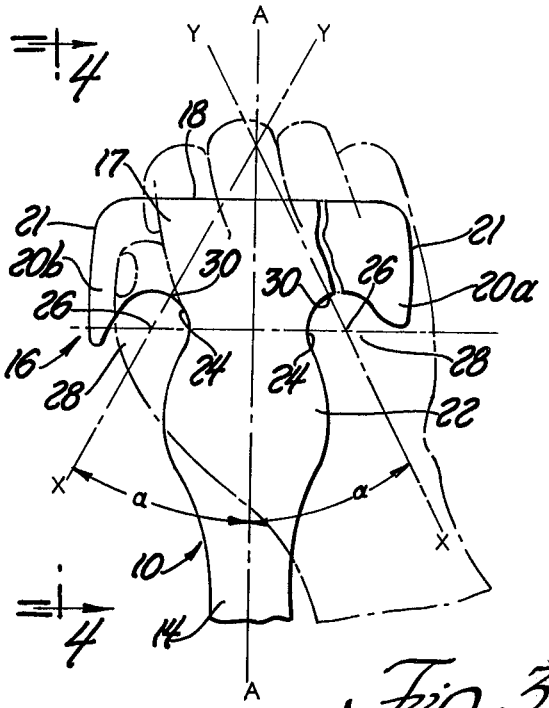
FIG. 3 is an enlarged fragmentary portion of FIG. 1 illustrating, in broken lines, the canoeist's hand gripping the improved handle.
Figure 4:
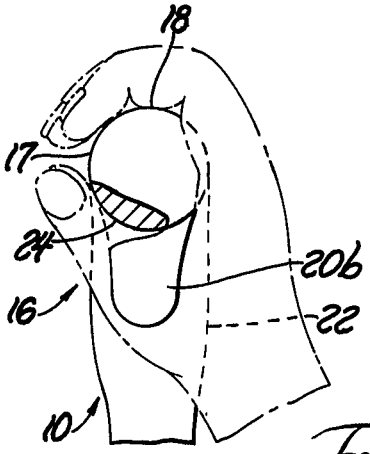
FIG. 4 is a fragmentary view, with a portion thereof broken away and in cross-section, taken on the plane of line 4—4 of FIG. 3.

Referring now more specifically to FIGS. 1, 3 and 4, it will be seen that the unencumbered end edge 18 on the cross member 17 of the handle 16 is gripped by the canoeist's fingers. The human hand is formed so that the thumb extends in generally the same direction as the base of the fingers (and in the opposite direction as the ends of the fingers) when the hand grips something that the fingers can encircle.

Accordingly, as shown in FIGS. 2, 3 and 4, the cross member 17 of handle 16 is formed with projections 20 extending generally parallel to the axis A—A of the paddle in the direction of the blade 12.

It will also be noted that the intermediate portion 14 of the paddle, which is usually generally cylindrical, is formed with a wider flattened portion 22 near the handle 16, so that when the fingers grip the edge 18, the lower palm of the hand engages and is suppported by portion 22.

The handle 16, including the adjacent edges of cross member 17, projection 20 and portion 22, is formed to provide a pair of generally circular, substantially identical openings 24 with centers 26 and having a diameter or width sufficient to receive, at various times during and under the pressure of paddling, the base of the canoeist's thumb, as shown in FIGS. 2 and 3. It will be seen in FIG. 3 that the widened portion is gently contoured to its maximum width and then gently narrowed to form the circular thumb saddles 24, the maximum width not substantially exceeding the distance between the centers 26.

In FIG. 3, the right-hand end of the handle 16 is broken away and the projection 20*a* extends at least to approximately the line 26—26 through the centers 26 of the circular openings 24. In the left-hand portion of handle 16, the projection 20*b* extends beyond the centerline 26—26. In either case, the projection may have (but not necessarily) an outer edge 21 that overall is substantially parallel to axis A—A.

It will be seen from FIG. 3 that the circular openings 24 are not complete circles, but that they have an open segment or slot 28 for easy access of the thumb, the resulting relatively short U-shaped slots having centerlines X–Y and a width approximately the diameter of the openings 24. It will also be noted the centerlines X–Y of the U-shaped slot openings 24 form acute angles a with the axis A—A of the paddle, preferably an angle approximating 45° or less, but substantially less than 90°.

Simple "T" handles having a vertical leg and a horizontal end cross bar, both usually of generally uniform cross section, are known; however, two fingers must be spread on the cross bar to accommodate the leg. One well-known type of paddle does not have a T handle; rather it has a knob-like wider portion at the free end of the intermediate member, but with nothing resembling a thumb saddle. Both of these prior art structures are thus somewhat difficult and tiring to use, especially for any substantial period of time.

With the configuration shown in FIG. 3, the handle can be gripped very easily by sliding the thumb over the gently contoured widened portion 22 and into the thumb opening or "saddle" 24 and then grasping the edge 18 with the fingers. The hand fits the modified-T or contoured handle 16 "like a glove", or vice versa, so to speak. Gripping of the handle 16 allows normal closing of the hand, with no spreading of the fingers, and the hand can easily be closed as tightly as required, or relaxed (as conditions warrant) to rest the hand. This is due essentially to the fact that the center of the thumb saddle (point 30 on centerline X–Y) is more nearly on the line (X–Y) on which maximum thumb pressure is naturally applied during paddling when the right arm is crossed toward the left gunwhale of the canoe or other craft, as seen in FIGS. 1 and 3.

Also, the thumb, being in its natural position, whether relaxed or applying pressure, cannot accidentally slip from its saddle 24 because projection 20 substantially prevents the thumb from lateral movement. This was not the case in my above-mentioned prior patent, wherein thumb saddle openings and function were not mentioned; that is, only the grapple function was contemplated and discussed at column 5, lines 39–44, the centerlines of the grapple openings being disposed more than 45°, and in fact approaching 90° (not the natural line of force of the thumb) with respect to the paddle axis.

Figure 5:
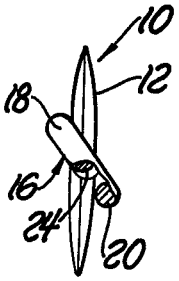
FIG. 5 is a top plan view, with portions thereof broken away and in cross-section, taken on the plane of line 5—5 of FIG. 2.

FIG. 5 illustrates, by broken away portions, the handle structure embodying the invention in a paddle having the planes of the handle and the blade offset, which was the main object of the invention of my above-mentioned patent.

Figure 6:
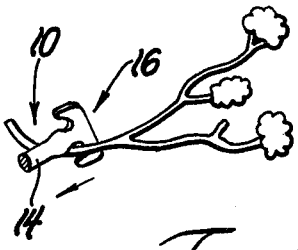
FIG. 6 is a perspective view illustrating the grapple hook use of the invention.

FIG. 6 illustrates the grapple function of the invention, as in snagging a small tree branch for purposes of holding the canoe temporarily near a tree.

In this connection, it will be apparent that while it is possible to provide either projections **20*a* or 20*b* at both ends of any given paddle, it may be desirable to provide one projection 20*a* and one projection 20*b*, using 20*a* as the thumb saddle and the longer projection 20*b* as the grapple. Also, any given canoeist may prefer 20*a* over 20*b***, or vice versa, as the thumb saddle.

As shown, all edges of the handle are preferably rounded to make use thereof more comfortable, and the paddle may be used interchangeably on either side.

From the above description, it will be seen that the proposed paddle structure meets the stated objects.

The invention has been disclosed and described in such clear and concise terms that anyone skilled in the art can practice the same.

While only one embodiment of the invention has been shown and described, with modification, other modifications may be made within the scope of the invention, and no limitations are intended except as recited in the appended claims:

What I claim as my invention is:

1. A paddle for manually propelling a watercraft such as a canoe, said paddle comprising a blade, a handle and an intermediate portion connecting said blade and said handle, said blade, handle and intermediate portion having substantially a common axis, said handle comprising an unencumbered edge transverse to said axis to be grasped by the canoeist's fingers and a contoured edge providing a saddle against which the base of the canoeist's thumb can exert pressure when the handle is gripped, said saddle being spaced from said axis such that substantially all of the fingers can grasp said edge, said handle being generally T-shaped and comprising a cross member at the end of said intermediate portion normal to said axis, said cross member having discreet projections at the ends thereof extending toward said blade and generally parallel to said axis, said intermediate portion having a wider flattened portion at said handle adapted and positioned so as to be engaged by the canoeist's lower palm when his fingers grip said transverse edge.

2. A paddle such as that recited in claim 1, wherein the adjacent edges of said projections, said cross member and said widened portion are formed to provide a substantially circular or generally U-shaped slot at each end of said handle of sufficient width to receive the base of the canoeist's thumb, said slot comprising said saddle and substantially preventing lateral thumb movement.

3. A paddle such as that recited in claim 2, wherein the edge of said widened portion is gently contoured outwardly to a maximum width not substantially greater than the distance between the centers of said circular openings and then gently inwardly to blend into said circular saddle.

4. A paddle such as that recited in claim 2, wherein the centerlines and sides of said slots form acute angles with said paddle axis, said angles approximately 45° or less, but substantially less than 90°.

5. A paddle such as that recited in claim 1, wherein said projections extend at least to approximately the line between the centers of said circular openings.

6. A paddle such as that recited in claim 1, wherein at least one of said projections extends beyond the line between the centers of said circular openings.

* * * * *